United States Patent [19]

Micallef

[11] Patent Number: 4,873,729

[45] Date of Patent: Oct. 17, 1989

[54] AUTOMATIC DEVICE FOR THE DISINFECTION OF W.C. BOWLS AND SEATS

[76] Inventor: Jacques Micallef, 14 rue Murillo, F-75008 Paris, France

[21] Appl. No.: 756,435

[22] PCT Filed: Nov. 16, 1984

[86] PCT No.: PCT/FR84/00264

§ 371 Date: Jul. 17, 1985

§ 102(e) Date: Jul. 17, 1985

[87] PCT Pub. No.: WO85/02214

PCT Pub. Date: May 23, 1985

[30] Foreign Application Priority Data

Nov. 18, 1983 [FR] France ..... 83 18364

[51] Int. Cl.[4] ..... A47K 13/00

[52] U.S. Cl. ..... 4/233; 4/222

[58] Field of Search ..... 4/233, 662, 300, 300.2, 4/222, 223, 227–231

[56] References Cited

U.S. PATENT DOCUMENTS

| | | | |
|---|---|---|---|
| 984,734 | 2/1911 | Baginsky | 4/223 |
| 1,051,631 | 1/1913 | Pickles | 4/233 |
| 1,327,275 | 1/1920 | Ferguson | 4/233 |
| 2,104,947 | 1/1938 | Joosten | 4/233 |
| 2,795,799 | 6/1958 | Dickerman | 4/222 |
| 3,344,441 | 10/1967 | Kelly | 4/233 |
| 4,216,553 | 8/1980 | Haberle | 4/233 |
| 4,358,860 | 11/1982 | Church | 4/227 |

FOREIGN PATENT DOCUMENTS

| | | | |
|---|---|---|---|
| 1939542 | 2/1971 | Fed. Rep. of Germany | 4/233 |
| 2258397 | 6/1974 | Fed. Rep. of Germany | 4/223 |
| 2621802 | 12/1977 | Fed. Rep. of Germany . | |
| 21166 | 9/1912 | United Kingdom | 4/223 |

*Primary Examiner*—Linda J. Sholl

*Attorney, Agent, or Firm*—William A. Drucker

[57] ABSTRACT

The collapsible cover (5) is designed to envelope the rim (3) and the seat (2) and is provided on its periphery with a seal (6). In the cover (5) there are incorporated conduits (7) which open on the inner face of said cover in a plurality of diffusion heads (8) which spread in order to spray jets throughout the inner surface of the bowl (1), on the seat (2) and on the upper and lower faces of the rim (3). The conduits (7) are connected to a disinfection product tank on which actuates a control member connected to the cover so that, by putting down the cover (5) a complete disinfection of the bowl (1), the seat (2) and the rim (3) is automatically effected. The device is particularly applicable to W.C. for public use.

14 Claims, 2 Drawing Sheets

AUTOMATIC DEVICE FOR THE DISINFECTION OF W.C. BOWLS AND SEATS

The present invention concerns a device that provides for the automatic disinfection of the pan and seat of a water-closet before it is at the disposal of a user.

At the present time, everybody has to make frequent use of public water-closets on various occasions in daily life, for example in places of work, when travelling (in transport vehicles such as trains, ships or planes, or in stations and airports, or else on the road, for example in car parks or gasoline stations), and in places of amusement and relaxation (such as theatres, restaurants etc.). For obvious reasons of hygiene, it is important for these users to be always assured of finding the sanitary fixtures of these public WCs, and especially the pans and seats of these WCs, perfectly clean and thoroughly disinfected even if, as if often the case, there is no staff available at all times to clean these fixtures.

Although, very often, these sanitary fixtures are kept clean, most of the time nothing is done to ensure that they are disinfected in a manner that can be verified.

It has been suggested that protective sheets, made of paper or cellulose compound and taking the shape of the folding seat, be used: the user could line the surface of the seat with these sheets and throw them away after use. This protective covering, however, has many disadvantages, firstly because it does not destroy any infectious germs that might be found on the seat and secondly because it concerns only the seat of the WC and not its pan, and also because it is not automatic in nature and may therefore be neglected or forgotten.

It has also been proposed that the interior of the folding lid of the WC seat be fitted with a ultraviolet lamp or tube whose electrical supply would be controlled automatically as soon as the lid is folded down on the seat, and whose radiation would be directed onto the surface of the pan and onto the seat, sterilizing these parts. Here again, however, the disadvantages entailed by this system are substantial, on the one hand because of the danger to the user from ultraviolet radiation and, on the other hand, because of the risks of deterioration due to the fragility of the ultraviolet lamps or tubes used.

The present invention is aimed at palliating the disadvantages of the known devices referred to above and, to this end, it proposes a device that is very simple to manufacture, and has a low cost price and high operating efficiency, enabling any user to obtain the automatic and total disinfection of the pans and seats of WCs fitted with this device, without having to perform any complicated or hazardous operation.

According to the invention, the folding lid, which is normally connected to the WC folding seat, it is designed to cover the said folding seat on all sides when in the folded position, and it has, suitably distributed over the inner surface and on its peripheral rim, dispersal holes connected by ducts, suitably placed within the said lid, to a tank containing a disinfectant product under pressure, with devices borne by the folding lid acting on the said tank to control, when the lid is in a totally folded position, the spraying process through the holes that disperse the streams of disinfectant which then reach the entire inner surface of the pan as well as the upper surface of the fixed seat and the upper and lower surfaces of the folding seat. A sealing joint, made of a product resistant to the effects of the disinfectant, is provided all along the edge of the lid and when the lid is folded, this joint works in close cooperation with the upper surface of the pan to prevent any of the product from seeping outwards.

Appropriately, the folding lid has, behind its pivoting axis, a box-shaped fixed element designed to receive the spraying control head of the tank containing the disinfectant, into which opens out one end of a flexible duct designed to fit the outlet hole of the said control head while the other end of this duct coincides, when the lid is folded, with the inlet hole of the ducts arranged inside the lid. The bottom part of this box has an opening into which the neck of the tank of disinfectant is inserted through a side door so as to attach the tank and, for this purpose, the neck has a special I shape. The top part of the box is open so that, when the lid is lifted, it is possible for a lever, forming one piece with this lid, to connect with the tank's detachable spraying control head.

It is preferable to use a disinfectant that dries almost instantaneously, one for example that has an alcohol or freon base, and it is possible to arrange for the shape of the folding seat to have a certain inward curve so as to enable the product sprayed on the upper surface of the folding seat to flow towards the pan.

It is clear that the lid, when in the raised position, actuates the control head of the tank of disinfectant through its extension but, at this moment, the inlet hole of the spraying ducts arranged in the lid do not face the outlet hole of the flexible duct joined to the bottom of the tank (since the outlet hole is then blocked by a solid part of the WC lid) and the product is therefore not sprayed. When the lid is subsequently folded down, the two holes referred to above come face to face with each other and spraying then occurs for a brief period of time determined by a spring system that acts on the control head in order to bring this head back to the rest position. Thus, should the user find, on his arrival, that the lid is not folded in the disinfecting position but is lifted, it would be enough for him to fold the lid and wait for a very short period of a few seconds before lifting the lid and then having, at his disposal, a pan and folding seat that are totally disinfected and completely dry.

To provide a clear explanation of the device according to the present invention, we describe below a preferred form of execution with reference to the appended diagram wherein.

Figure 1:
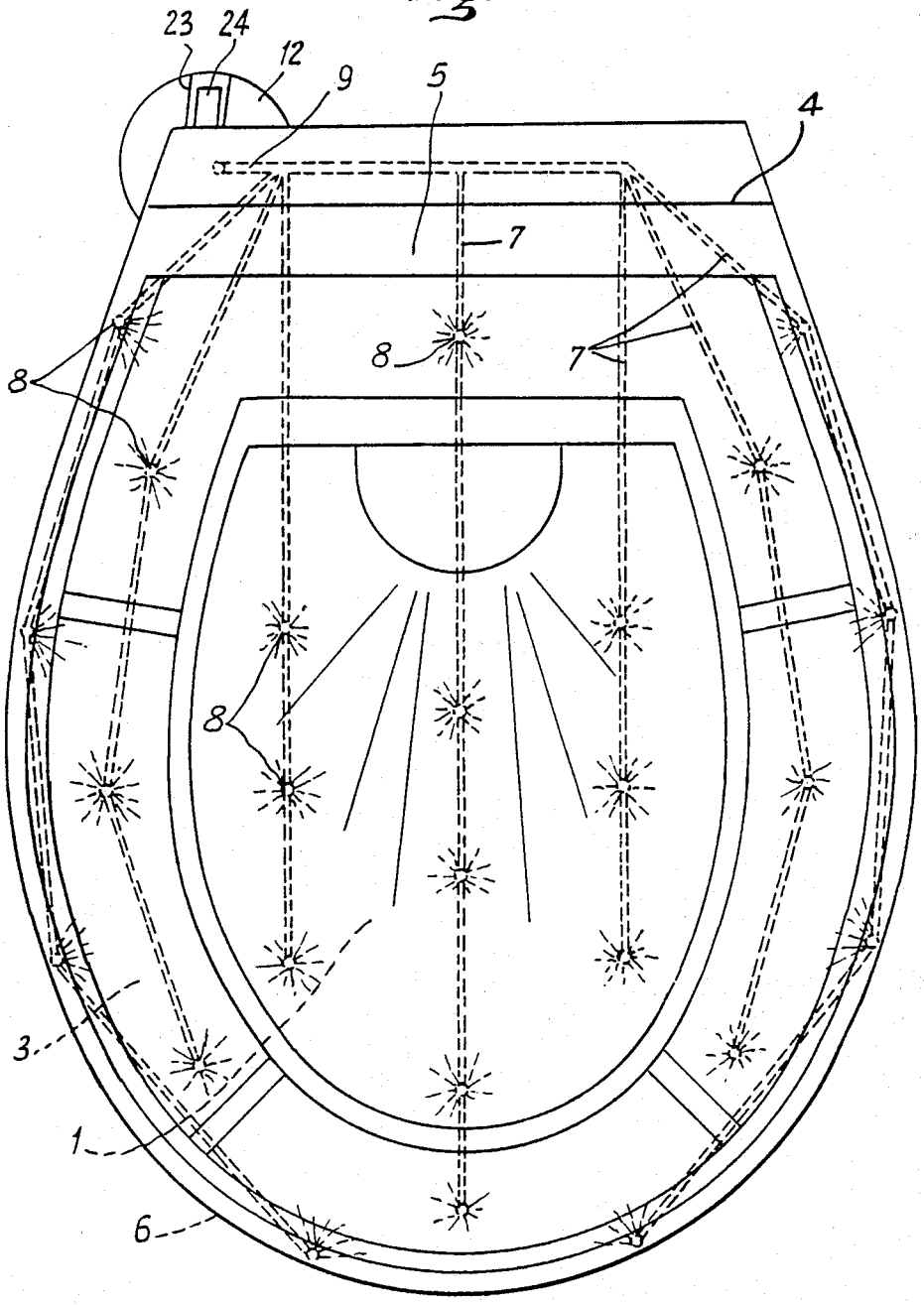
FIG. 1 is an overview of a WC pan fitted with an automatic disinfecting device according to the present invention.
Figure 2:
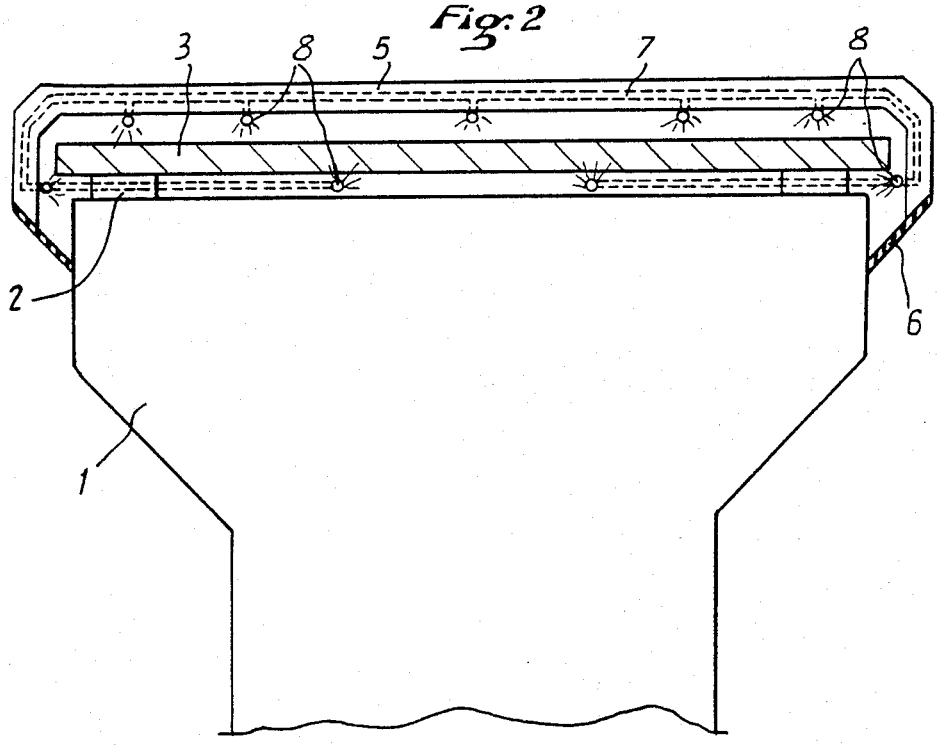
FIG. 2 is a vertical view of the pan in FIG. 1.
Figure 3:
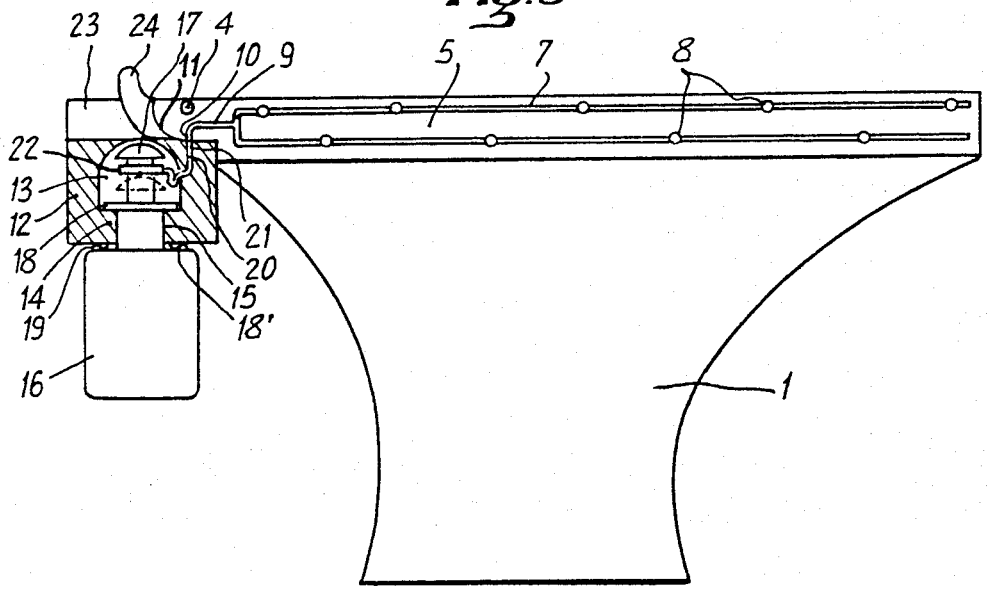
FIG. 3 is a side, partial cut-away, showing, in particular, the automatic actuating device for the disinfectant tank.

The drawing shows 1 the WC pan on the upper rim of the fixed seat 2 which supports the folding seat 3. Around a horizontal pin 4, on its rear side, there hinges a lid 5 with rims on its edge enabling this lid, when it is in the folded position shown in FIGS. 1 and 2, to cover the folding seat 3. On its edge, the lid 5 has a sealing joint 6 made of a material resistant to chemical attack, and especially to the action of disinfectants, and designed to come into close contact with the external peripheral surface of the pan 1 in the folded position of the lid 5.

The lid 5 is made of moulded plastic material and has ducts 7, which come from the moulding and which open out on the inner surface of the lid through dispersal heads 8. These heads are arranged all over the inner plane surface of the lid 5, as well as on its inner curved edges in such a way that when the ducts 7 are supplied with a disinfectant, in a manner that shall be explained further below, the heads 8 spray streams of the product which reach the whole inner surface of the pan, the whole fixed seat 2 and the totality of the top and bottom sides of the folding seat 3.

All the ducts 7 supplying the dispersal heads 8 lead into a main duct 9 arranged at the rear part of the lid 5 and this main duct 9 opens out by a hole 10 on to an arched part 11 of the rear end of the lid 5.

At its rear end, the lid 5 is extended by a box-shaped fixed part 12 containing an inner chamber 13 whose bottom wall 14 is open at 15. Fitted sideways into this opening 15 is the neck of a tank 16 containing a disinfectant product under pressure, the fitting being such that the detachable ejection-control head 17 of the product is housed inside chamber 13 while the shell of the tank 16 extends beneath the box 12. The vertical section of the tank neck 16 has a special I shape with upper shoulderings 18 and lower shoulderings 18' which are fitted to both sides of the bottom wall 14. Springs 19 borne on the inner surface of the wall 14 catch the shouldering 18' of the tank 16 in order to ensure that this tank is properly held in its position of use. On its side, the box 12 is closed by a door, not visible in the drawing, which can be appropriately locked in order to present access to the tank 16 and its removal by any unauthorized person.

The front wall of the box 12 houses a flexible duct 20 whose end 21 opens out to the exterior exactly facing the hole 10 of the main duct 9 of the lid 5 when this lid is folded. The other end of the flexible duct 20 is set inside the chamber 13 and comprises a collar 22 designed to connect with the detachable head 17 in such a way that the end of the duct 21 is held facing the outlet hole (not shown) placed in the head 17. A spring device (of a known type which has not been shown for purposes of clarity in the drawing) makes it possible, when the head 17 has been pushed in (in the way that will be seen below) then released, to bring this head back to the top position within a preset period of time.

In its upper part, the box 12 incorporates, in the pin of the lid 5, a central opening 23 which communicates with the chamber 13 and through which a rear extension 24 of the lid 5 can enter the chamber 13, when the lid pivots from the folded to the lifted position, by catching the detachable head 17 and forcing it to penetrate vertically.

The working of the device is easily understood from the above description. When the lid 5 is in the lifted position, its rear extension 24 pushes in the detachable head 17, causing the ejection of the product through the duct 20. However since, at this moment, the outlet hole 21 of this duct is blocked by the solid arched part 11 of the lid 5, the product is not distributed to the ducts 9 and 7 of this lid. When the lid 5 is then folded over the pan, the part 14 of this lid frees the head 17 which rises slowly under the action of the draw-back spring. At the same time, the hole 10 of the duct 9 comes to face the end 21 of the duct 20, thus enabling, until the head 17 returns to its top resting position, the dispersal through the ducts 7 and the heads 8 of the streams of disinfectant which, because of the suitable arrangement of the heads 8, reaches the totality of the inner surface of the pan 1, the surface of the fixed seat 2 and the lower and upper surfaces of the folding seat 3. This folding seat is planned so that it presents, all along its surface, an inclined shape, directed inwards, thus making it easy for any excess of disinfectant sprayed on its upper surface to flow into the pan 1. The sealing joint 6, provided for on the edge of the lid 5, prevents any disinfectant from spreading outwards.

A few seconds after the lid 5 has been folded down, the head 17 automatically returns to the resting position, cutting off the emission of the product and, since the disinfectant used is appropriately based on a volatile product such as alcohol or fréon, the sanitary fixtures become immediately dry and can be used at once.

When the tank 16 is empty and when its replacement is desired, it is enough to open the side door of the box 12 and apply upward pressure on the tank 16 in order to cancel the action of the springs 19, then slide the neck of this tank sideways out of the box 12. The collar 22 is then removed and fitted to the detachable head of a full tank, and then the above procedure is performed in reverse to place the fresh tank in its position of use.

It will be understood that the above description has been given only by way of example, without being exhaustive in nature, and that additions or modifications may be made to it without departing from the scope of the invention. In particular, the disinfectant used may be of any appropriate composition and may contain additives such as deodorant materials.

What I claim is:

1. In a toilet comprising a pan, a fixed seat integral with the upper edge of the pan and a folding seat movable between an upper position and a lower position in which a lower face of said folding seat engages the fixed seat, an automatic disinfection device which comprises:

(a) a folding lid made of molded plastic material, said folding lid being movable between an upper open position and a lower closed position, said folding lid having a plane portion and a curved edge of which the inner surface, in the closed position, registers with the outer edges of the folding seat and of the fixed seat, (b) a sealing joint fixed to the end portion of the curved edge of the lid and adapted, in the closed position of the lid, to come in close contact with the external peripheral surface of the pan, (c) molded ducts in the folding lid, (d) a plurality of dispersal heads provided on the entire inner surface of the plane portion and of the curved edge of the folding lid, said heads being disposed to project a disinfection product on the inner surface of the pan, on the fixed seat and on the upper and lower surfaces of the folding seat, each dispersal head being connected to one of said ducts, (e) a main duct molded in a rear part of said folding lid and to which said ducts are connected, (f) a tank containing a disinfectant product under pressure, disposed in the vicinity of the rear portion of said folding lid, (g) a flexible duct connecting said main duct to an outlet of the tank, (h) and means on said folding lid adapted to co-act with a control portion of said tank to cause, in the closed position of said lid, said tank outlet to feed the dispersal heads through said flexible duct, said main duct and said ducts with disinfection product.

2. An automatic disinfection device according to claim 1 wherein said folding lid presents at its rear end a fixed part forming a box to which said tank is attached, the box having a chamber in which is housed a detachable spray-controlling head of the tank connected to said flexible duct, the said box having an upper opening through which can move an extension of the folding lid, said extension engaging and pushing said detachable head to feed the flexible duct with disinfectant when the folding lid moves from a closed position to an open position.

3. Device under claim 2, wherein the end of the flexible duct (20), opening into the interior of the chamber (13) of the box (12) includes a collar (22) designed to be fastened to the detachable head (17), while a compression spring is connected to the said detachable head (17) to draw it back to its resting position within a preset period of time.

4. Device according to claim 2, wherein the bottom wall (14) of the box (12) is provided with an opening (15) which is accessible sideways to receive the neck of the tank (16).

5. Device under any claim 1, wherein the disinfectant product has a volatile base such as alcohol or freon.

6. Device according to claim 1, wherein the lid (5) is made of plastic material with the ducts (7) and the dispersal heads (8) molded therein.

7. Device under claim 1, wherein the inlet hole of the network of ducts (7) of the lid (5), opening out into dispersal heads, is connected to the supply system of the flushing cistern.

8. Tank for disinfection product under pressure for feeding the device of claim 4, which presents a neck of a shape paired with the shape of the opening (15) in the bottom wall (14) of the box (12), for example a I-shaped section with upper (18) and lower (18') shoulderings bearing on the edges of said opening (15).

9. In a toilet comprising a pan, a fixed seat solid with the upper edge of the pan and a folding seat movable between an upper position and a lower position in which a lower face of said folding seat engages the fixed seat, an automatic disinfection device which comprises:

(a) a folding lid made of molded plastic material, said folding lid being movable between an upper open position and a lower closed position, said folding lid having a plane portion and a curved edge of which the inner surface, in the closed position, registers with the outer edges of the folding seat and of the fixed seat, (b) a sealing joint fixed to the end portion of the curved edge of the lid and adapted, in the closed position of the lid, to come in close contact with the external peripheral surface of the pan, (c) ducts coming from molding in the folding lid, (d) a plurality of dispersal heads provided on the whole inner surface of the plane portion and of the curved edge of the folding lid, said heads being disposed to project a disinfection product on the inner surface of the pan, on the fixed seat and on the upper and lower surfaces of the folding seat, each dispersal head being connected to one of said ducts, (e) a main duct molded in a rear part of said folding lid and to which said ducts are connected, (f) a box formed by a fixed part of the rear end of said folding lid and to which a tank containing disinfectant product under pressure is attached, (g) a detachable spray-controlling head of said tank housed within a chamber of said box and connected to the flexible duct, said flexible duct having an outlet hole which presses against an inlet hole of the main duct when the folding lid is in its closed position, (h) a solid arched part of said folding lid adapted, when the lid is not in its closed position, to engage said outlet hole of the flexible duct preventing the feeding of the ducts with disinfection product, and (i) an upper opening provided in said box and through which an extension of the folding lid can move, said extension engaging and pushing said detachable head to feed the flexible duct with disinfectant when the folding lid moves from its closed position to its open position.

10. Device under claim 9 wherein the end of the flexible duct (20), opening into the interior of the chamber (13) of the box (12) includes a collar (22) designed to be fastened to the detachable head (17), while a compression spring is connected to the said detachable head (17) to draw it back to its resting position within a preset period of time.

11. Device according to claim 10 wherein the bottom wall (14) of the box (12) is provided with an opening (15) which is accessible sideways to receive the neck of the tank (16).

12. Device according to claim 11 wherein the disinfectant product has a volatile base such as alcohol or freon.

13. Device according to claim 12 wherein the lid (5) is made of plastic material with the ducts (7) and the dispersal heads (8) molded therein.

14. Tank for disinfection product under pressure for feeding the device of claim 11, which presents a neck of a shape paired with the shape of the opening (15) in the bottom wall (14) of the box (12), for example an I-shaped section with upper (18) and lower (18') shoulderings bearing on the edges of said opening (15).

* * * * *